US011643852B2

(12) United States Patent
Drost et al.

(10) Patent No.: US 11,643,852 B2
(45) Date of Patent: May 9, 2023

(54) MOTOR-VEHICLE DOOR LOCK

(71) Applicant: Kiekert AG, Heiligenhaus (DE)

(72) Inventors: Bernhard Drost, Isselburg (DE); Murat Özdogan, Wuppertal (DE); Michael Scholz, Essen (DE); Holger Schiffer, Meerbusch (DE)

(73) Assignee: Kiekert AG, Heiligenhaus (DE)

( * ) Notice: Subject to any disclaimer, the term of this patent is extended or adjusted under 35 U.S.C. 154(b) by 99 days.

(21) Appl. No.: 16/980,876

(22) PCT Filed: Mar. 1, 2019

(86) PCT No.: PCT/DE2019/100187

§ 371 (c)(1),
(2) Date: Sep. 15, 2020

(87) PCT Pub. No.: WO2019/185080

PCT Pub. Date: Oct. 3, 2019

(65) Prior Publication Data

US 2021/0017794 A1 Jan. 21, 2021

(30) Foreign Application Priority Data

Mar. 27, 2018 (DE) ..... 10 2018 107 210.4

(51) Int. Cl.
*E05B 81/06* (2014.01)
*E05B 83/24* (2014.01)

(52) U.S. Cl.
CPC ..... *E05B 81/06* (2013.01); *E05B 83/24* (2013.01)

(58) Field of Classification Search
CPC ..... E05B 81/06; E05B 83/24; E05B 81/20; E05B 83/16

(Continued)

(56) References Cited

U.S. PATENT DOCUMENTS 7,380,844 B2 6/2008 Berghahn
8,474,888 B2 * 7/2013 Tomaszewski ..... E05B 77/30 292/216

(Continued)

FOREIGN PATENT DOCUMENTS

CN 111364859 A * 7/2020 ..... E05B 77/26
DE 2557970 A1 7/1997

(Continued)

OTHER PUBLICATIONS

Translation of International Search Report dated Jun. 12, 2019 for PCT/DE2019/100187.

*Primary Examiner* — Kristina R Fulton
*Assistant Examiner* — James Edward Ignaczewski
(74) *Attorney, Agent, or Firm* — Renner, Otto, Boisselle & Sklar, LLP

(57) ABSTRACT

A motor vehicle door lock, more particularly a flap lock or a hood lock includes a locking mechanism substantially consisting of a rotary latch and a pawl. There is also a motorized closing aid which has a motor and also a first lever, which is acted upon by the motor, and a second lever. The two levers are hinged to each other. During the lowering of a flap or hood, the second lever first of all carries out a movement, which is controlled by the rotary latch, while simultaneously freewheeling in relation to the first lever. Only following the freewheeling does the first lever, which is then driven, act upon the second lever, in order to close the rotary latch.

14 Claims, 2 Drawing Sheets

(58) Field of Classification Search
USPC ..... 292/201
See application file for complete search history.

(56) References Cited

U.S. PATENT DOCUMENTS

| | | | | |
|---|---|---|---|---|
| 10,378,252 | B2 * | 8/2019 | Ottino | E05B 81/68 |
| 11,180,936 | B2 * | 11/2021 | Kim | E05B 81/06 |
| 2016/0244999 | A1 * | 8/2016 | Ottino | E05B 85/26 |
| 2017/0298661 | A1 * | 10/2017 | Byun | E05B 81/20 |
| 2018/0073284 | A1 * | 3/2018 | Im | E05B 83/18 |

FOREIGN PATENT DOCUMENTS

| | | | | |
|---|---|---|---|---|
| DE | 19823574 | A1 * | 12/1999 | E05B 83/24 |
| DE | 10028445 | A1 * | 12/2001 | E05F 15/41 |
| DE | 10028445 | A1 | 12/2001 | |
| DE | 19823574 | B4 | 6/2006 | |
| EP | 1778937 | A1 | 5/2007 | |
| EP | 1635017 | B1 | 8/2010 | |

* cited by examiner

MOTOR-VEHICLE DOOR LOCK

FIELD OF INVENTION

The invention relates to a motor vehicle door lock, more particularly a flap lock or a hood lock, with a locking mechanism substantially consisting of a rotary latch and a pawl, and with a motorized closing aid which has a motor and also a first lever, which is acted upon by the motor, and a second lever, the two levers being hinged to each other.

BACKGROUND OF INVENTION

Flap locks or hood locks are generally used in conjunction with flaps or hoods on motor vehicles in order to latch the relevant flap or hood relative to the motor vehicle body. The relevant hood may be a front hood for covering an engine compartment or also a tailgate, a side flap, etc. Naturally, such flap locks or hood locks must bridge relatively large gaps during the closing operation. Consequently, such motor vehicle door locks are typically equipped with catch hooks for additional securing.

In order to be able to close the described large gap region, relatively complicated kinematics are often obtained. Thus, the generic prior art according to EP 1 635 017 B1 concerns a closure for a movable body part of a vehicle which is equipped with a motorized closing aid. The closing aid has two stationary levers pivotably mounted in the lock. Overall, the objective pursued is that of implementing few components and a space-saving design.

However, the known closing aid uses an active working lever, which is pivotable by the motor, having a working slide and a sliding block guided therein and additionally a passive control lever having a control slide in which the same sliding block is guided. The working slide crosses the control slide, wherein the sliding block is positioned in the crossing point of the two slides and has a shoulder, while the rotary latch is equipped with an associated counter-shoulder. During motorized pivoting of the working lever the shoulder of the sliding block strikes the counter-shoulder of the rotary latch and in this way rotates the rotary latch from its pre-catch position into a main catch position.

The crossed layout of the two slides with the sliding block in the crossing point is problematic if a permanent and functionally reliable operation is to be guaranteed. Moreover, the known motor vehicle door lock or the corresponding closure for a tailgate is provided. An additional anti-trap protection in conjunction with the closing aid is not explicitly addressed. In fact, the known teaching assumes that such anti-trap protection is no longer required as soon as the pre-catch position has been assumed. Since only the known closing aid transfers the closure from the pre-catch position into the main catch position, obviously such a problem should not occur.

An engine hood closure is described within the scope of DE 198 23 574 B4 A. The engine hood closure has an erecting spring as erecting element, an unlocking lever and also a catch hook. The catch hook can be moved by the unlocking lever into a release position. In this case the erecting spring steers the unlocking lever by means of a lever transmission into a ready position in such a way that the erecting spring engages on a control lever on which the unlocking lever is articulated. In this way the actuation of the unlocking lever should take place as far as possible independently of tolerances. As a result, the known teaching aims in particular to compensate for joint tolerances during closing of the engine hood.

SUMMARY OF INVENTION

The invention is based on the technical problem of further developing a motor vehicle door lock of the type described in the introduction so that a large gap region can be obtained while simultaneously taking an anti-trap protection into consideration and at the same time with a simple mechanical effort.

In order to solve this technical problem, a generic motor vehicle door lock within the scope of the invention is characterized in that during the lowering of a flap or hood the second lever first of all carries out a movement, which is controlled by the rotary latch, while simultaneously freewheeling in relation to the first lever, and only following this freewheeling does the first lever, which is then driven, act upon the second lever in order to close the rotary latch.

Within the scope of the invention first of all a particularly simple kinematics is used in order also to be able to bridge and close large gap regions. In this connection the invention mainly uses the first lever, which is acted upon by the motor, and the second lever hinged thereto. Further levers are not required but are nevertheless conceivable and are covered by the invention. Moreover, in the motor vehicle door lock according to the invention two phases of the movement during the closing operation can be distinguished from one another and are functionally separate from one another. In this case, one phase relates to the lowering movement of the relevant flap or hood initially completed by the hood and the other phase relates to the closing movement which follows the lowering movement.

The lowering movement is initiated or advantageously completed so that a drive engaging on the first lever first of all lowers an erecting element which acts on the flap or hood and thus lowers the flap or hood. Only then does the closing movement take place and the rotary latch is closed. During the lowering movement the second lever freewheels in relation to the first lever. In other words, during the lowering movement the drive acting on the first lever ensures, solely by means of the movement of the first lever initiated thereby, that the erecting element is lowered. In this way the flap or hood automatically follows this lowering movement.

For this purpose, in detail, the first lever can compress the erecting element. Thus, it is possible that the erecting element designed, for example, as an erecting spring is compressed with the aid of the first lever acted upon by the drive. In any case the lowering of the erecting element, or specifically the compression of the erecting spring, ensures that simultaneously the hood or flap is lowered and the lowering movement is carried out.

During this lowering movement the second lever remains unaffected because of the freewheeling in relation to the first lever. In other words, the routinely observed pivoting movement of the first lever associated with the lowering movement of the erecting element does not ensure that in this case the second lever is also acted on in any way.

Due to the freewheeling of the second lever in relation to the first lever during the lowering movement, the second lever can follow the movement controlled by the rotary latch. For this purpose, the rotary latch advantageously has a pin and in particular a control cam. With the aid of the pin or the control cam the rotary latch controls the movement of the second lever.

Only when the second lever has completed a predetermined travel path, as a result of this control by the rotary latch, is the second lever advantageously engaged in relation to the first lever. The engagement ends the lowering movement and also the freewheeling of the second lever in relation to the first lever. In this way, following this, the rotary latch can be closed. The driven first lever is now capable of acting on the rotary latch via the engaged second lever for closing.

In this way the invention ensures that the lowering movement, on the one hand, and the closing movement, on the other hand, are mechanically separated from one another. As a result, a unique (and mechanical) security against premature closing is achieved. The transition from the lowering movement to the closing movement is, on the one hand, coupled to the fact that the rotary latch or the second lever controlled in this connection has completed the predetermined travel path and, on the other hand, the second lever is engaged in relation to the first lever and the freewheeling is ended. Only if all of these conditions are met is it the case that the drive acting on the first lever works, and also can work, on the rotary latch via the engaged second lever for closing. Consequently, an effective anti-trap protection is also obtained.

The drive engaging on the first lever is generally stopped during the lowering movement if resistance occurs. In fact, the drive works merely on the first lever during the lowering movement, so that the erecting element is acted upon with a low force. In this way an effective anti-trap protection can be achieved during the lowering movement, because the drive can be stopped immediately when a resistance occurs. This can be achieved in detail, for example, when the current drawn by the motor is analyzed for its action thereon and an increase in current is interpreted as an occurrence of resistance. Consequently, the relevant motor can be stopped, so that the required anti-trap protection is observed. Thus, an additional sensor is unnecessary.

Furthermore, the closing operation is only started when the lowering movement is completed. Only the completed lowering movement leads overall to the second lever being engaged in relation to the first lever acted upon by the motor and the freewheeling has been ended thereby. In the event of resistance occurring previously, this functional position is not reached, because the drive acting on the first lever is stopped.

In any case the closing operation or the closing movement is only initiated and started when the second lever has fully completed the travel path controlled by the rotary latch and is engaged in relation to the first lever. This engaging operation can be detected, for example, by sensors.

Moreover, depending upon the design of the second lever and also of the pin or control cam on the rotary latch, it is possible to predetermine and, where appropriate, to vary the time and also the functional position which corresponds to the transition from the lowering movement to the closing movement.

In principle, the engaging operation of the second lever in relation to the first lever can also be used purely mechanically and without sensor-based detection in order to start the closing movement. In this case by means of an evaluation of the electric current drawn by the motorized drive for the first lever it is again possible to identify whether the second lever is engaged in relation to the first lever. During the closing movement the drive operates via the first lever on the engaged second lever in such a way that the rotary latch is acted upon by a torque which is increased relative to the erecting element. This increased torque and a resulting increased current consumption of the drive can again be detected and evaluated.

Thus whereas the first lever can move during the lowering movement in relation to the second lever due to the freewheeling, during the closing movement the engaged second lever ensures in relation to the first lever that the rotary latch can now be acted upon for closing. For this purpose, the second lever typically works on the relevant pin or control cam. Since in this case the drive, viewed over the two levers, acts upon the rotary latch for closing, due to the kinematics achieved in this way, an increased torque can be used in order to complete the closing movement. In fact, depending upon the design of the two levers the torque engaging on the rotary latch can even be varied during the closing operation.

As a rule, the second lever has a slide which predetermines the freewheeling. For this purpose, the slide serves for guiding a pin which engages therein on the first lever. Consequently, by the combination of the described freewheeling and the control of the second lever with the aid of the rotary latch, overall an anti-trap protection is obtained by mechanical means. An additional sensor system is not necessary but is of course possible. Moreover, due to the respective designs of the two levers, any transmission of the rotary movement from the motor to the first and second lever for lowering and closing can be changed and, where appropriate, varied. The essential advantages can be seen herein.

BRIEF DESCRIPTION OF DRAWINGS

The invention is explained in greater detail below with reference to drawings which show only one embodiment, and in which.

DETAILED DESCRIPTION

Figure 1:
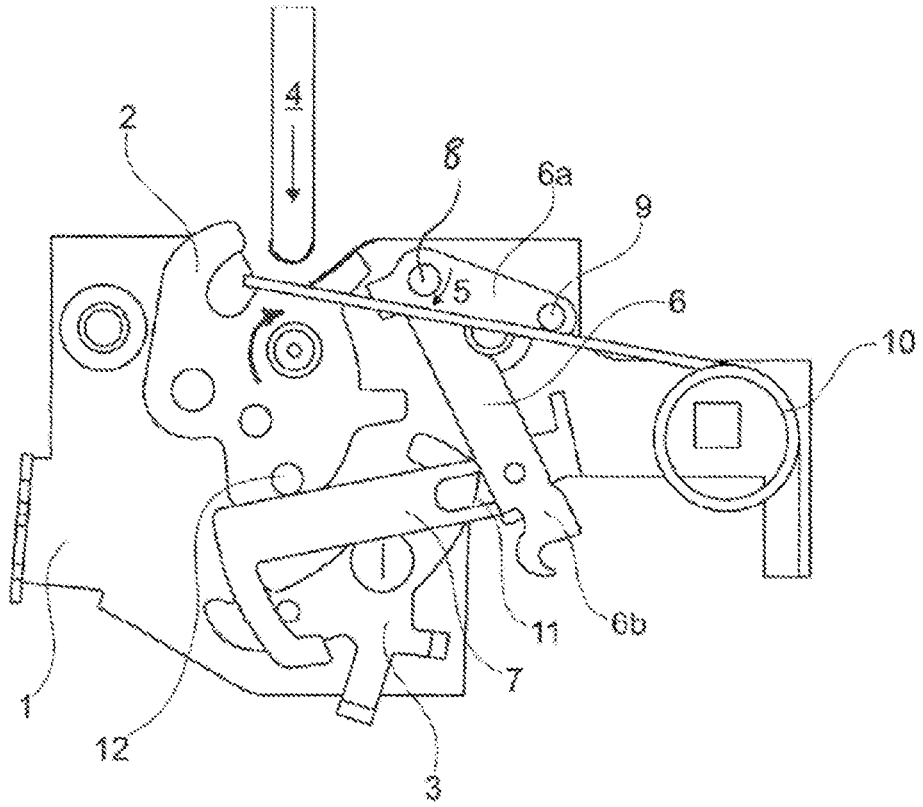
FIG. 1 shows the motor vehicle door lock according to the invention at the beginning of a lowering movement and FIG. 2 shows the motor vehicle door lock at the end of the lowering movement and at the beginning of the closing movement.

The figures depict a motor vehicle door lock which is, in a non-limiting manner, a flap lock or a hood lock. In fact, the relevant motor vehicle door lock is used, for example, in conjunction with a front hood for covering an engine compartment in a motor vehicle. For this purpose, the motor vehicle door lock has a metal lock case 1 in which a locking mechanism 2, 3 substantially consisting of a rotary latch 2 and a pawl 3 is rotatably mounted. Moreover, a closing bolt or catch bolt 4 is provided which is connected to the hood or flap (not explicitly illustrated) or the front hood already previously described.

In the exemplary case, the illustrated motor vehicle door lock 1 is placed at the front of the motor vehicle body, for example in the region of a radiator provided there or also a front flap in a vehicle with a rear-mounted engine. For closing of the front hood, the relevant hood or flap is lowered.

This corresponds to a lowering movement of the closing bolt or catch bolt 4, which is indicated in FIG. 1 by an arrow. Due to this lowering movement of the catch bolt or closing bolt 4, the rotary latch 2 is pivoted clockwise during the transition from the functional position of FIG. 1 to FIG. 2. This is indicated by an arrow in FIG. 1.

A motorized closing aid 5, 6, 7 forms part of the fundamental further design of the illustrated motor vehicle door lock. The motorized closing aid 5, 6, 7 has a motor 5 and also a first lever 6, which is acted upon by the motor 5, and a second lever 7. The motor 5 is merely indicated by an arrow in the figures and ensures that the first lever 6 which is acted upon by the motor 5 can carry out mainly pivoting movements in a clockwise direction about its associated axis 8.

The first lever 6 is equipped with a spring arm 6*a* and a lever arm 6*b*, which are arranged at an angle to one another. In the exemplary embodiment, between the spring arm 6*a* and the lever arm 6*b* of the first lever 6 an angle is observed which is in the range from approximately 50° to 70°, which of course only applies by way of example and is not in any way obligatory. Moreover, the first lever 6 has a pin 9, with the aid of which the first lever 6 or the spring arm 6*a* thereof acts upon one leg of a leg spring 10.

This leg spring 10 is generally an erecting element 10 or an erecting spring 10. The erecting element or the erecting spring 10 ensures that the closing bolt or catch bolt 4 is erected with a spring force contrary to the lowering movement illustrated by the arrow in FIG. 1. The same also then applies for the front hood connected to the closing bolt or catch bolt 4. This is erected with the aid of the erecting element or the erecting spring 10 relative to the motor vehicle body so that, for example, a catch hook (not explicitly illustrated) is accessible in order to be able to erect the front hood completely following the opened position of the motor vehicle door lock illustrated in FIG. 1.

The two levers 6, 7 are hinged to each other. Moreover, the second lever 7 has a slide 11. A pin on the lever arm 6*b* of the first lever 6 engages in the slide 11. The slide 11 with the pin engaging therein predetermines a freewheeling of the second lever 7 in relation to the first lever 6, as is explained in greater detail below.

Figure 2:
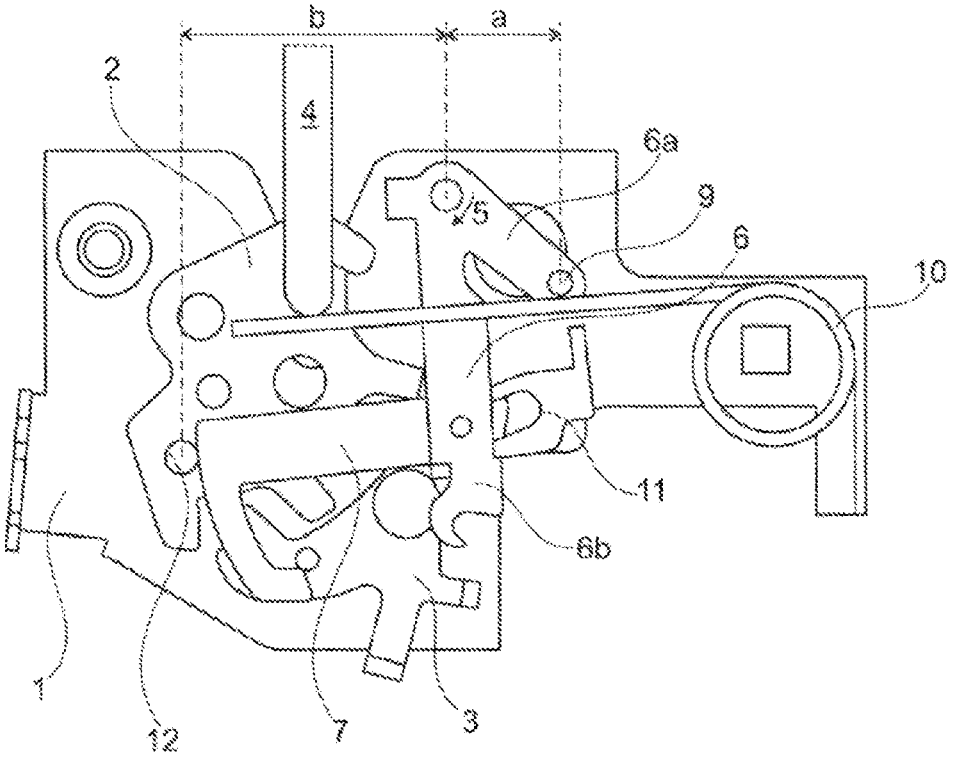

The mode of operation is as follows. Starting from the opened position of the motor vehicle door lock according to FIG. 1, which also corresponds to the deployed position of the front hood (not illustrated) and thus of the closing bolt or catch bolt 4, the second lever 7 initially completes a movement controlled by the rotary latch 2 during lowering of the relevant flap or hood. For this purpose the rotary latch 2 has a pin 12, which in the representation according to FIG. 1 initially slides along on an upper edge of the second lever 7 and during the transition from the functional position according to FIG. 1 to FIG. 2 abuts a front edge of the second lever 7, as illustrated in FIG. 2. During this lowering movement, the rotary latch 2 rotates clockwise during the transition from FIG. 1 to FIG. 2. This clockwise movement is initiated by the lowering locking bolt or catch bolt 4, which progressively penetrates into an inlet opening surrounding the closing bolt 4 according to the representation in FIG. 2 and in this case turns the rotary latch 2 in a clockwise direction.

Due to the clockwise movement of the rotary latch 2 in the described lowering operation or the lowering movement in the transition from FIG. 1 to FIG. 2, the relevant pin or control cam 12 slides on the rotary latch 2 initially along the upper edge of the second lever 7 and then comes into abutment on the front edge of the second lever 7, as depicted in FIG. 2 at the end of the described lowering movement.

Within the scope of the exemplary embodiment, the previously described lowering movement of the front hood and consequently of the closing bolt or catch bolt 4 is effected in that the drive 5 engaging on the first lever 6 or acting on the first lever 6 turns the relevant first lever 6 in a clockwise direction. In this way the pin 9 comes into engagement with the erecting spring 10 on the spring arm 6*a* in such a way that the erecting spring 10 is compressed. In the same way, the erecting spring or the erecting element 10 is lowered, as can be recognized in the transition from FIG. 1 to FIG. 2. Since the erecting spring 10 with its one leg erects the closing bolt or catch bolt 4 and in the opened state of the motor vehicle door lock according to FIG. 1 is in a relaxed state, the lowering of the closing bolt or catch bolt 4 corresponds to compression of the erecting element or the erecting spring 10 as the drive 5 works on the first lever 6 in a corresponding direction.

At the same time, the closing bolt or catch bolt 4 which penetrates into the inlet opening of the rotary latch 2 ensures that the rotary latch 2 turns clockwise during the transition from FIG. 1 to FIG. 2. The pin or control cam 12 located on the rotary latch 2 initially slides along on the upper edge of the second lever 7 and reaches the front edge of the second lever 7 at the end of the lowering movement in the context of the functional position according to FIG. 2.

After the completion of the previously described and predetermined travel path the second lever 7 is engaged in relation to the first lever 6, as is made clear by the engaged position according to FIG. 2. Consequently, following the functional position according to FIG. 2 and at the end of the lowering movement of the locking bolt or catch bolt 4, the rotary latch 2 can be closed, as is explained in greater detail below.

During the lowering movement of the flap or hood the second lever 7 carries out the movement induced by the previously already described freewheeling in relation to the first lever 6 and controlled by the rotary latch 2. In fact, the freewheeling obtained by the interaction of the slide 11 with the pin engaging therein on the first lever 6 allows not only the movement of the second lever 7 controlled by the rotary latch 2 during the lowering movement. However, at the same time the freewheeling enables the first lever 6 to lower the erecting element or the erecting spring 10 correspondingly so that the rotary latch 2 actually carries out the clockwise movement necessary for the control. In fact, the lowering movement or compression of the erecting spring 10 corresponds to a situation where the pin engaging in the slide 11 on the lever arm 6*b* of the first lever 6 in the exemplary embodiment travels from a right end position inside the slide 11 to a left end position inside the slide 11 during the transition from FIG. 1 to FIG. 2.

As soon as the relevant pin engaging in the slide 11 comes into abutment on the left-hand stop inside the slide 11, at the same time, the second lever 7 is located in the engaged position in relation to the first lever 6. The pin or control cam 12 abuts the front edge of the second lever 7.

A further action of the motor 5 and thus of the first lever 6 now leads to the first lever 6 and the second lever 7 being mechanically coupled to one another and leads to ending of the freewheeling achieved by the slide 11 and the pin engaging therein on the lever arm 6*b* of the first lever 6. In this way, starting from the functional position according to FIG. 2, the rotary latch 2 can be closed and the closing movement can be started. In other words, following the lowering movement and with the second lever 7 engaged, the drive 5 engaging on the first lever 6 starts the closing movement, specifically starting from the functional position according to FIG. 2.

During the closing movement the drive 5 works via the first lever 6 on the engaged second lever 7 in such a way that the rotary latch 2 is acted upon by a torque which is increased in relation to the erecting element 10.

This can be fundamentally attributed to the fact that a significantly lengthened lever arm is observed. During the lowering movement the motor 5 works via the spring arm 6*a* and the pin 9 on the relevant erecting element 10, taking a lever arm a shown in FIG. 2 into consideration, whereas the corresponding lever arm b composed of both levers 6, 7 for the closing movement is significantly longer. Accordingly, the rotary latch 2 can be acted upon by the motor 5 with a significantly higher torque than is observed for the action on the erecting element 10. Moreover, it is clear that, depending upon the design of the two levers 6, 7, the torque engaging on the rotary latch 2 can also be varied in principle during the closing operation or the closing movement.

In addition to the separate design of the lowering movement, on the one hand, and the closing movement, on the other hand, and due to the mechanical separation and securing against premature closing carried out by the movement of the second lever 7 controlled by the rotary latch 2, a particularly effective anti-trap protection is observed. If, for example, resistance occurs during the lowering movement in the transition from FIG. 1 to FIG. 2, the motor 5 is immediately stopped. This is possible without problems, particularly since only a low electrical power on the motor 5 is necessary for the described lowering operation. As soon as, for example, the current consumption on the motor 5 increases in this connection, this can be interpreted as unforeseen resistance and this current increase can be used in order to switch off the motor 5. Only when the lowering operation or the lowering movement is completely implemented without registered resistance, and the functional position according to FIG. 2 has been reached, is the closing movement then started. During this closing movement the motor 5 works on the rotary latch 2 via the first lever 6 and the engaged second lever 7 as a whole on the pin or control cam 12 on the rotary latch in such a way that the rotary latch 2 is turned further in the clockwise direction. As a result, the locking bolt or catch bolt 4 is lowered further and consequently the front hood connected thereto in the exemplary case is closed, usually against restoring forces built up by a peripheral seal.

It will be recognized that the anti-trap protection as a whole can be obtained mechanically and no further sensor system is necessary, and in fact by way of example the evaluation of the current drawn by the motor 5 or the electrical power drawn is sufficient. Moreover, the combined actuation of the second lever 7 via the rotary latch 2 in conjunction with the freewheeling implemented by the slide 11 ensures that the closing operation or the closing movement is secured mechanically and is explicitly only started when the functional position in FIG. 2 is reached. The essential advantages can be seen here.

The invention claimed is:

1. A motor vehicle door lock for a flap or a hood, the motor vehicle door lock comprising:

a locking mechanism including a rotary latch and a pawl, a motorized closing aid which has a motor, a first lever which is acted upon by the motor, and a second lever in contact with a pin on the rotary latch, the first lever and the second lever being hinged to each other, wherein during lowering of the flap or hood, the rotary latch pivots and the second lever first carries out a movement along a predetermined travel path which is controlled by movement of the pin as the rotary latch pivots, while simultaneously freewheeling in relation to the first lever, wherein, after completing the predetermined travel path, the second lever is engaged in relation to the first lever, and wherein, only following the engagement, the first lever is driven by the motor and acts upon the rotary latch by way of the engagement with the second lever and the second lever contacting the pin to move the rotary latch into a closed position, wherein the second lever has a slot and the first lever has a pin that engages in the slot, wherein the pin of the first lever moves in the slot from a right end position inside the slot to a left end position inside the slot as the second lever carries out the movement along the predetermined travel path to engage the first lever and the second lever, wherein the motor acting on the first lever only causes a corresponding movement of the rotary latch when the pin of the first lever engages the left end position of the slot of the second lever and the second lever engages the pin of the rotary latch.

2. The motor vehicle door lock according to claim 1, wherein the motor is configured to lower an erecting element which acts upon the flap or hood and thus lowers the flap or hood.

3. The motor vehicle door lock according to claim 1, wherein during the lowering of the flap or hood, the second lever carries out the movement induced by the freewheeling in relation to the first lever and controlled by the rotary latch.

4. The motor vehicle door lock according to claim 1, wherein the motor is stopped when resistance occurs during the lowering.

5. The motor vehicle door lock according to claim 2, wherein, following the lowering and when the second lever is engaged with the first lever, the motor starts a closing movement.

6. The motor vehicle door lock according to claim 5, wherein, during the closing movement, the motor acts via the first lever on the engaged second lever in such a way that the rotary latch is acted upon by a torque which is increased in relation to the erecting element.

7. The motor vehicle door lock according to claim 6, wherein the torque engaging on the rotary latch is varied during the closing movement.

8. The motor vehicle door lock according to claim 1, wherein the pin of the rotary latch is a control cam.

9. The motor vehicle door lock according to claim 1, wherein the first lever includes a spring arm and a lever arm that are angled relative to each other.

10. The motor vehicle door lock according to claim 2, wherein the erecting element is a leg spring.

11. The motor vehicle door lock according to claim 10, wherein the leg spring is compressed during the lowering.

12. The motor vehicle door lock according to claim 1 further comprising a closing bolt, wherein the rotary latch is pivoted by the power of the closing bolt.

13. The motor vehicle door lock according to claim 1, wherein the freewheeling of the second lever ends when the second lever is engaged with the first lever.

14. The motor vehicle door lock according to claim 10, wherein lowering the erecting element comprises lowering a leg of the leg spring, wherein the first lever includes a second pin in contact with the leg of the leg spring such that as the leg is lowered, the second pin travels along the leg of the leg spring causing the first lever to pivot and move the pin of the first lever in the slot.

* * * * *